United States Patent [19]

Mizoguchi

[11] Patent Number: 4,719,057

[45] **Date of Patent: * Jan. 12, 1988**

[54] HUMIDIFIER BLOWOFF PORTION

[75] Inventor: Saburo Mizoguchi, Osaka, Japan

[73] Assignee: Sharp Kabushiki Kaisha, Osaka, Japan

[ * ] Notice: The portion of the term of this patent subsequent to Feb. 3, 2004 has been disclaimed.

[21] Appl. No.: 901,777

[22] Filed: Aug. 29, 1986

Related U.S. Application Data

[63] Continuation of Ser. No. 718,228, Apr. 1, 1985, Pat. No. 4,640,804.

[30] Foreign Application Priority Data

Apr. 2, 1984 [JP] Japan ..... 59-48705[U]

[51] Int. Cl.[4] ..... B01F 3/04; B01F 11/02

[52] U.S. Cl. ..... 261/81; 222/108; 222/188; 239/338; 261/1; 261/DIG. 48; 366/127

[58] Field of Search ..... 261/78 A, 81, 1, 91, 261/30, DIG. 48, DIG. 65; 222/108, 188; 55/257 R, 257 NP; 239/102, 338; 366/127

[56] References Cited

U.S. PATENT DOCUMENTS

| | | | |
|---|---|---|---|
| 2,118,695 | 5/1938 | Bahnson | 261/91 |
| 3,188,007 | 6/1965 | Myklebust | 261/91 X |
| 3,229,450 | 1/1966 | Stern | 261/91 X |
| 3,985,299 | 10/1976 | Brenez | 222/108 X |
| 4,087,495 | 5/1978 | Umehara | 261/81 |
| 4,238,425 | 12/1980 | Matsuoka et al. | 261/81 |
| 4,257,989 | 3/1981 | Nishikawa | 261/81 X |
| 4,410,139 | 10/1983 | Nishikawa et al. | 261/DIG. 48 |
| 4,531,657 | 7/1985 | Saito et al. | 222/108 |

FOREIGN PATENT DOCUMENTS

| | | | |
|---|---|---|---|
| 68038 | 5/1979 | Japan | 261/81 |

*Primary Examiner*—Richard L. Chiesa

*Attorney, Agent, or Firm*—Birch, Stewart, Kolasch & Birch

[57] ABSTRACT

A humidifier for humidifying air comprises a storing member for storing water, an atomizing device for atomizing the water supplied from the water storing member, a blower for blowing air into the atomizing device, a blowoff member for dispersing atomized water particles into air, a connecting member for connecting the blowoff member with the atomizing device, and an inhibiting member for inhibiting capillary action of the water in the connection member.

18 Claims, 5 Drawing Figures

PRIOR ART

FIG. 3
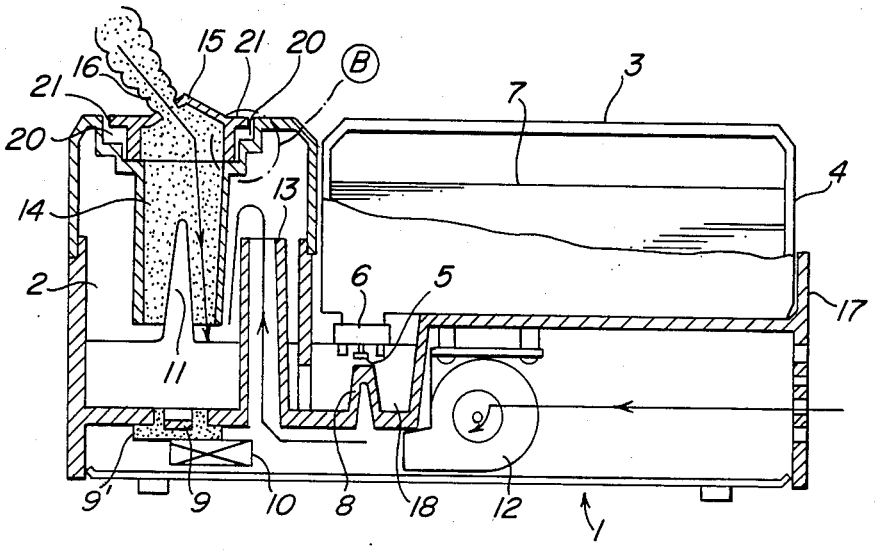
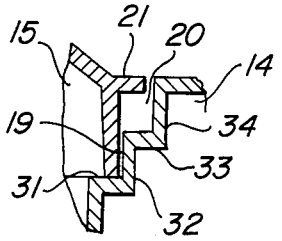
FIG. 4

HUMIDIFIER BLOWOFF PORTION

This application is a continuation of copending application Ser. No. 718,228, filed on 4/1/85, now U.S. Pat. No. 4,640,804.

BACKGROUND OF THE INVENTION

The present invention relates to a humidifier such as an ultrasonic humidifier and, more particularly, to a blowoff portion for a humidifier through which atomized water particles can be dispersed into the atmosphere.

In a conventional humidifier, because a blowoff member for dispersing atomized water particles is detachably engaged with an atomizing cylinder, a small gap may be formed between the blowoff member and the atomizing cylinder. Accordingly, the atomized water particles may be liquid at the small gap and the resultant water flows out of the small gap by a capillary action. If the humidifier has been continuously operated for a long time, the water accumulated in the gap may flow out from the humidifier. Therefore, it is desired to provide an improved humidifier for atomizing water and dispersing it so as to prevent the overflow of water.

SUMMARY OF THE INVENTION

Accordingly, it is an object of the present invention to provide an improved humidifier which can disperse atomized water particles in air without water overflowing through the connection of its blowoff portion.

It is another object of the present invention to provide an improved humidifier which prevents water from overflowing from a connection between a blowoff member and an atomizing cylinder.

Other objects and further scope of applicability of the present invention will become apparent from the detailed description given hereinafter. It should be understood, however, that the detailed description of and specific examples, while indicating preferred embodiments of the present invention, are given by way of illustration only, since various changes and modifications within the spirit and scope of the present invention will become apparent to those skilled in the art from this detailed description.

To achieve these and other objects according to an embodiment of the present invention, a humidifier for humidifying air comprises storing means for storing water, means for atomizing the water supplied from said storing means, means for blowing air into said atomizing means, blowoff means for dispersing atomized water particles into air, connecting means for connecting said blowoff means with said atomizing means, and means for inhibiting a capillary action of the water in the connection means. For example, the atomizing means comprises an atomizing chamber and an atomizing cylinder downwardly projected from the upper wall of the atomizing chamber, the cylinder having a free end in the lower direction. The blowoff means comprises a blowoff member provided with an outlet at the upper portion thereof and having a free end in the lower direction, and is detachably and rotatably connected with the atomizing means. The inhibiting means is a groove means, and the groove means forms with either the setback portion of the blowoff member in combination with the wall of the connecting means or the setback portion of the connecting means in combination with the wall of the blowoff member. An eave is integrally provided with the blowoff member for covering the groove means.

BRIEF DESCRIPTION OF THE DRAWINGS

The present invention will be better understood from the detailed description given hereinbelow and the accompanying drawings which are given by way of illustration only, and thus are not limitative of the scope of present invention and wherein:

FIG. 3 shows a cross sectional view of a humidifier according to a preferred embodiment of the present invention;

FIG. 4 shows an enlarged cross sectional view of a blowoff portion indicated by character B in FIG. 3.

DETAILED DESCRIPTION OF THE INVENTION

Figure 1:
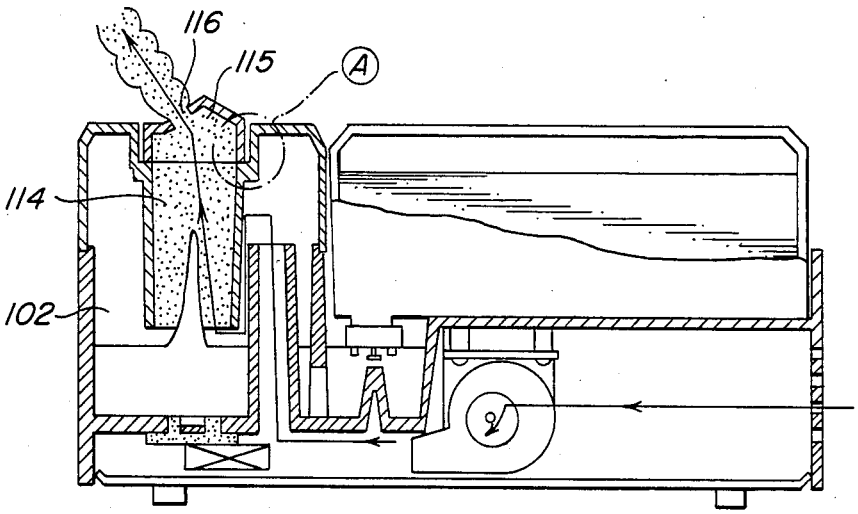
FIG. 1 PRIOR ART
FIG. 1 shows a cross sectional view of a humidifier including a conventional blowoff member.
Figure 2:
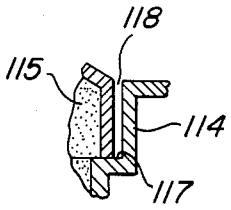
FIG. 2 shows an enlarged cross sectional view of the conventional blowoff portion indicated by character A in FIG. 1.

To facilitate more complete understanding of the present invention, a humidifier including the conventional blowoff portion will be described with reference to FIGS. 1 and 2.

An atomizing cylinder 114 is provided for atomizing water in an atomizing chamber 102. The atomizing cylinder 114 extends from the upper wall of the atomizing chamber 102 in the lower direction. A blowoff cap 115 is provided for dispersing atomized water particles into the atmosphere and has a free end at the lower portion thereof.

A blowoff member seat portion 117 (FIG. 2) is provided at the middle end of the atomizing cylinder 114 for storing the blowoff cap 115. The blowoff cap 115 having an outlet 116 is inserted into the upper portion of an atomizing cylinder 114, and rotatably and detachably coupled with the blowoff member seat portion 117 of the atomizing cylinder 114. An inside diameter of the atomizing cylinder 114 positioned under the couple between the blowoff cap 115 and the atomizing cylinder 114 is equal to or less than that of the free end of the blowoff cap 115. The inside diameter of the vertical wall of the blowoff member seat portion 117 of the atomizing cylinder 114 is equal to or more than the outside diameter of the side wall of the blowoff cap 115. The blowoff cap 115 is inserted into the blowoff member seat portion 117 so that the side wall of the blowoff cap 115 is closely in contact with and stressed inwardly by the vertical wall of the blowoff member seat portion 117 of the atomizing cylinder 114.

In this humidifier, water in an chamber is atomized by the atomizing cylinder 114, and the atomized water particles are dispersed from the outlet 116 of the blowoff cap 115 into the atomsphere. The atomizing cylinder 114 projects from the main body of the humidifier. However, in the conventional blowoff member as shown in FIG. 2, a small gap 118 is inevitably formed between the side wall of the blowoff cap 115 and the vertical wall of the blowoff member seat portion 117 of the atomizing cylinder 114. In this case, when the humidifier is continuously driven for a long time, atomized water particles adhere to a horizontal wall of the blowoff member seat portion 117 and are liquified so that the resultant water flows out of the gap 118 by a capillary action. Finally, the water thereby overflows from the gap 118 to wet a floor or a table carrying the humidifier.

A humidifier according to a preferred embodiment of the present invention will be described with reference to FIGS. 3 and 4. The present invention can eliminate the above problem.

FIG. 3 shows a cross sectional view of a humidifier according to a preferred embodiment of the present invention. FIG. 4 shows an enlarged cross sectional view of a blowoff portion of the humidifier of FIG. 3.

A humidifier 1, mainly, comprises an atomizing chamber 2 at the left side of the humidifier 1 and a water tank storing chamber 4 for storing a water tank 3 at the right side of the humidifier 1.

The water tank 3 is, for example, made of a transparent or translucent synthetic resin, and is provided with a cap 6 having a water feed valve 5 at the end of the bottom wall of the water tank 3. A water supply portion 18 is provided at the front side of the bottom wall of the water tank storing chamber 4 and communicates with the atomizing chamber 2. The cap 6 is screwed to the water tank 3 and is positioned so that water 7 in the water tank 3 is supplied to the water supply portion 18 when the water feed valve 5 is pressed.

A push pole 8 projects from a bottom wall of the water supply portion 18 opposite the water feed valve 5 and presses the water feed valve 5 when the water tank 3 is stored in the water tank storing chamber 4. The atomizing chamber 2 communicates with the water supply portion 13, so that the amount of water in the atomizing chamber 2 always is constant. If the amount of the water in the chamber 2 becomes less than a predetermined amount, the water 7 in the water tank 3 is supplied into the atomizing chamber 2 through the water supply portion 18 and the cap 6.

An ultrasonic vibrator 9 is disposed at the bottom wall of the atomizing chamber 2 for vibrating water in the atomizing chamber 2 and driven by a driver 10. The ultrasonic vibrator 9 is held by a heat radiating plate 9'. A high frequency voltage is applied to the ultrasonic vibrator 9 from the driver 10. When the ultrasonic vibrator 9 is driven by the driver 10, the water in the atomizing chamber 2 is vibrated and an ultrasonic water column 11 is formed on the surface of the vibrator 9. Therefore, the atomized water particles are produced from the surface of the ultrasonic water column 11. An air blower 12 is disposed under the water tank storing chamber 4 for blowing air toward the the ultrasonic water column 11 in the atomizing chamber 2. An air inlet cylinder 13 is upwardly extruded from or disposed on the bottom wall of the atomizing chamber 2 so as to introduce air from the air blower 12 into the atomizing chamber 2. The atomizing chamber 2 communicates with the atmosphere through the air inlet cylinder 13 and air inlet holes 17.

An atomizing cylinder 14 is integrally and downwardly provided on the upper wall of the atomizing chamber 2 to communicate the atomizing chamber 2 with the atmosphere. The free end of the atomizing cylinder 14 faces in the direction of the bottom wall of the atomizing chamber 2. The upper portion of the atomizing cylinder 14 is formed in a step or a setback form. The step portion of the atomizing cylinder 14 includes a first horizontal wall 31, a first vertical wall 32, a second horizontal wall 33, and a second vertical wall 34.

A blowoff member such as a blowoff cap 15 has an outlet 16 for dispersing atomized water particles into the atomsphere. The blowoff cap 15 is inserted into the step portion of the atomizing cylinder 14 so that the side wall of the blowoff cap 15 is coupled with the first horizontal wall 31 and the first vertical wall 32 of the atomizing cylinder 14. The lower section of the side wall of the blowoff cap 15 is in close contact with the first vertical wall 32 of the atomizing cylinder 14. In other words, the end of the side wall of the blowoff cap 15 is fixed by the first horizontal wall 31, and the side wall of the blowoff cap 15 is inwardly stressed by the first vertical wall 32 so that the blowoff cap 15 is rotatably and detachably provided at the upper portion of the atomizing cylinder 14. The diameter of the atomizing cylinder 14 positioned under the coupling between the blowoff cap 15 and the atomizing cylinder 14 is equal to or less than that of the blowoff cap 15. The diameter of the first vertical wall 32 of the atomizing cylinder 14 is equal to or greater than the outside diameter of the blowoff cap 15. The diameter of the second vertical wall 34 of the atomizing cylinder 14 is greater than that of the first vertical wall 32 of the atomizing cylinder 14 so that a ring-like groove 20 is formed over the periphery, between both the side wall of the blowoff cap 15 and the first horizontal wall 33, and the second vertical wall 34 of the atomizing cylinder 14. The lower end of the blowoff cap 15 is opened and the outlet 16 is provided at the upper portion of the blowoff cap 15.

The blowoff cap 15 is further provided with an eave 21 projected from the upper end of the side wall of the blowoff cap 15 over the circle of the blowoff cap 15. The eave 21 is formed in the direction of the upper end of the second vertical wall 34 of the atomizing cylinder 14, that is a horizontal direction, and is provided all around the blowoff cap 15 for covering the ring-like groove 20. The ring-like groove 20 cannot be seen from the outside due to the eave 21.

The operation of the humidifier 1 will be described below.

When a start switch (not shown) of the humidifier is set ON, the supersonic vibrator 9 is driven by the driver 10, and the same time the blower 12 is driven by a motor. The ultrasonic water column 11 is formed on the surface of the water in the atomizing chamber 2 and is covered by the atomizing cylinder 14. The air blowen by the blower 12 is introduced into the atomizing chamber 2 through the air inlet cylinder 13, and after, forcibly discharged from the outlet 16 of the blowoff cap 15 through the atomizing cylinder 14. During this time, the atomized water particles produced from the surface of the ultrasonic water column 11 are dispersed from the outlet 16 of the blowoff cap 15 with the air introduced from the blower 12. Therefore, the surrounding atmosphere is humidified.

In the preferred embodiment of the present invention, the upper portion of the atomizing cylinder 14 is formed in the step or the setback form, and the eave 21 is provided around the upper end of the vertical wall of the blowoff cap 15. Therefore, the blowoff cap 15 is inserted into the upper portion of the atomizing cylinder 14 so that the side wall of the blowoff cap 15 is inwardly stressed by the first vertical wall 32 of the atomizing cylinder 14. The second horizontal wall 33, the second vertical wall 34 of the step portion of the atomizing cylinder 14, and the eave 21 and the side wall of the blowoff cap 15 form the groove 20 having a volume sufficient for inhibiting the capillary action of the water produced at the connection between the blowoff cap 15 and the atomizing cylinder 14.

Of course, even in the preferred embodiment of the present invention, a small gap 19 may be formed between the first horizontal wall 31 and the end of the side wall of the blowoff cap 15, and the first vertical wall 32 of the atomizing cylinder 14 and the side wall of the blowoff cap 15, so that the water in the atomizing chamber 2 flows out the small gap 19 by a capillary action. Because the ring-like groove 20 is provided, the water overflowing from the upper end of the small gap 19 is accumulated in the groove 20, so that water does not flow out of the machine.

The capillary action of the water does not occur in the ring-like groove 20 because the groove 20 is so wide. Since only a small amount of water is could possibly accumulate in the groove 20, the accumulated water does not overflow from the groove 20.

Figure 5:
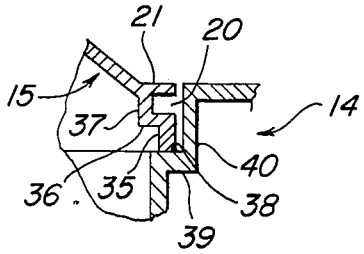
FIG. 5 shows an enlarged cross sectional view of a blowoff portion for a humidifier according to another embodiment of the present invention.

FIG. 5 shows an enlarged cross sectional view of a blowoff portion of a humidifier according to another embodiment of the present invention. The like elements corresponding to the parts of FIGS. 3 and 4 are denoted by like reference numerals in FIG. 5.

The side wall of the blowoff cap 15 forms a step portion comprising a first vertical wall 35, a first horizontal wall 36, and a second vertical wall 37. The atomizing cylinder 14 has a seat portion 38 for the blowoff cap 15 including a horizontal wall 39 and a vertical wall 40.

The blowoff cap 15 is inserted in the upper portion of the atomizing cylinder 14 so that the end of the first vertical wall 35 is fixed by the horizontal wall 39 of the atomizing cylinder 14, and the first vertical wall 35 is inwardly stressed by the vertical wall 40 of the atomizing cylinder 14. The first horizontal wall 36, the second vertical wall 37 of the blowoff cap 15, and the vertical wall 40 of the atomizing cylinder 14 form a ring-like groove 20. The eave 21 is integrally provided with the blowoff cap 15 for covering the ring-like groove 20.

The diameter of the vertical wall 40 is greater than that of the atomizing cylinder 14 positioned under the blowoff cap seat portion 38. The diameter of the second vertical wall 37 of the blowoff cap 15 is less than that of the first vertical wall 35 of the blowoff cap 15.

As described above, the blowoff member is inserted into and coupled with the atomizing cylinder by inwardly stressing the side wall of the blowoff member with the vertical wall of the atomizing cylinder. A ring-like groove is provided above the couple of the blowoff member and atomizing cylinder for inhibiting the capillary action of the water at the connection thereof. Although water could possibly flow out of the small gap provided at the connection by the capillary action, the groove member prevents this. Therefore, any water overflowing from the connection between the blowoff member and the atomizing cylinder is prevented from flow out of the machine.

In the present invention, the capillary action is stopped by the groove means having a predetermind width more than the width suitable for capillary action. The shape and the construction of the groove means should not be limited to the examples as shown above. The width of the groove means may be more than about 2 mm, preferably, more than about 3 mm. The depth of the groove means can be changed according to the width of it.

The invention being thus described, it will be obvious that the same may be varied in many ways. Such variations are not to be regarded as a departure from the spirit and scope of the invention, and all such modifications are intended to be included within the scope of the following claims.

What is claimed is:

1. A humidifier, comprising:

a first chamber means for storing water;

a second chamber means in communication with said first chamber means for receiving water therefrom;

means for atomizing water supplied from said first chamber means to said second chamber means;

a cylinder, provided on an upper wall of said second chamber means, for providing communication between said second chamber and the atmosphere, the upper portion of said cylinder having a step-like configuration comprising one horizontal wall and one vertical wall; and a cap, having a step-like configuration including first and second vertical walls and a horizontal wall, and an opening for discharging atomized water into the atmosphere, said cap being rotatably and detachably secured in the step-portion of said cylinder so as to form a groove between said second vertical wall of said cap and said vertical wall of said cylinder for inhibiting capillary action of water produced at an interface between said cap and cylinder.

2. The humidifier of claim 1, which further comprises an eave extending from an upper end of said second vertical wall of said cap for covering said groove.

3. The humidifier of claim 1, herein said atomizing means further comprises an ultrasonic vibrator disposed under a bottom wall of said second chamber means.

4. The humidifier of claim 3, wherein said atomzing means further comprises means for blowing air into said cylinder.

5. The humidifier of claim 4, further comprising an air inlet cylinder disposed on a bottom wall of said second chamber means for introducing air from said air blowing means to said cylinder.

6. The humidifier of claim 1, wherein said groove has a ring-like configuration.

7. The humidifier of claim 1, wherein said first vertical wall of said cap is inwardly stressed by said vertical wall of said step portion of said cylinder.

8. The humidifier of claim 1, wherein said groove has a width of greater than about 2 mm.

9. A humidifier, comprising:

a first chamber means for storing water;

a second chamber means in communication with said first chamber means for receiving water therefrom;

means for atomizing water supplied from said first chamber means to said second chamber means;

a cylinder, provided on an upper wall of said second chamber means, for providing communication between said second chamber and the atmosphere, the upper portion of said cylinder having a step-like configuration comprising at least two horizontal walls and at least two vertical walls; and a cap, having a side wall and an opening for discharging atomized water into the atmosphere, said cap being rotatably and detachably secured in the step-portion of said cylinder so as to form a groove between said side wall of said cap, and said second horizontal wall and said second vertical wall of said cylinder.

10. The humidifier of claim 9, which further comprises an eave extending from an upper end of said cap for covering said groove.

11. The humidifier of claim 9, wherein said atomizing means further comprises an ultrasonic vibrator disposed under a bottom wall of said second chamber means.

12. The humidifier of claim 11, wherein said atomizing means further comprises means for blowing air into said cylinder.

13. The humidifier of claim 12, further comprising an air inlet cylinder disposed on a bottom wall of said second chamber means for introducing air from said air blowing means to said cylinder.

14. The humidifier of claim 9, wherein said groove has a ring-like configuration.

15. The humidifier of claim 9, wherein said groove has a width of greater than about 2 mm.

16. The humidifier of claim 9, wherein said cap is coupled with said first horizontal wall and said first vertical wall of said cylinder.

17. The humidifier of claim 9, wherein said side wall of said cap is fixed by said first horizontal wall of said cylinder, and is inwardly stressed by said first vertical wall of said cylinder.

18. The humidifier of claim 9, wherein a diameter of said second vertical wall of said cylinder is equal to or greater than a diameter of said first vertical wall of said cylinder.

* * * * *